US006983791B2

(12) United States Patent
Hsu

(10) Patent No.: US 6,983,791 B2
(45) Date of Patent: Jan. 10, 2006

(54) HEAT PIPE HAVING FIBER WICK STRUCTURE

(76) Inventor: Hul Chun Hsu, P.O. Box 26-757, Taipei (TW) 106

( * ) Notice: Subject to any disclaimer, the term of this patent is extended or adjusted under 35 U.S.C. 154(b) by 8 days.

(21) Appl. No.: 10/729,064

(22) Filed: Dec. 5, 2003

(65) Prior Publication Data

US 2004/0112450 A1 Jun. 17, 2004

(30) Foreign Application Priority Data

Dec. 6, 2002 (TW) ..... 91135486 A

(51) Int. Cl.
*F28D 15/00* (2006.01)

(52) U.S. Cl. ..... 165/104.26; 165/104.33; 361/700; 361/704

(58) Field of Classification Search ..... 165/104.26, 165/104.19, 104.33, 185, 104.21; 361/700; 174/15.2; 257/714–716
See application file for complete search history.

(56) References Cited

U.S. PATENT DOCUMENTS

| | | | | |
|---|---|---|---|---|
| 3,587,725 | A * | 6/1971 | Basiulis | 165/104.26 |
| 3,921,710 | A * | 11/1975 | Katayama | 165/104.26 |
| 4,011,104 | A * | 3/1977 | Basiulis | 136/205 |
| 4,109,709 | A * | 8/1978 | Honda et al. | 165/104.26 |
| 4,542,980 | A * | 9/1985 | Tajima | 399/336 |
| 4,601,331 | A * | 7/1986 | Kessler et al. | 165/104.33 |
| 4,929,414 | A * | 5/1990 | Leonard et al. | 419/2 |
| 6,446,706 | B1 * | 9/2002 | Rosenfeld et al. | 165/46 |
| 6,619,384 | B2 * | 9/2003 | Moon et al. | 165/104.26 |
| 2001/0004934 | A1 * | 6/2001 | Yamamoto et al. | 165/104.11 |

* cited by examiner

*Primary Examiner*—Terrell McKinnon

(57) ABSTRACT

A heat pipe has a pipe container and a fiber wick structure. The fiber wick structure is arranged on an inner wall of the pipe container, and the fiber wick structure has at least two kinds of fibers with different melting points. Furthermore, when the fiber wick structure is manufactured in a sintering process, the higher melting point of fiber provides a support force for the fiber wick structure coupled to the inner wall of the pipe container, and the lower melting point of fiber is melted in the sintering temperature of the pipe container to adhere to the higher melting point of fiber on the inner wall of the pipe container.

6 Claims, 3 Drawing Sheets

HEAT PIPE HAVING FIBER WICK STRUCTURE

BACKGROUND OF THE INVENTION

1. Field of the Invention

The present invention relates to a heat pipe and, more particularly to a heat pipe having at least two kinds of fibers with different melting points to constitute a fiber wick structure, which can ensure that the fiber wick structure completely adheres to an inner wall of the heat pipe.

2. Description of the Related Art

Recently, with a remarkable development of electronics and telecommunications, a high speed/large capacity system is increasingly used, so a power consumption of the system or a generated heat per unit area of the system is increased. In order to disperse and radiate the generated heat, a heat sink, a fan attached to the heat sink, or an immersion cooling system is generally employed.

The conventional cooling apparatus mentioned above have many problems such as an insufficient heat transport capacity, noisiness, and a large size of the cooling system. As a solution of the problems of the conventional cooling apparatus, a heat pipe is used. A heat pipe is a passive cooling apparatus having no noise, a good response to heat and a good transport capacity of the heat.

In general, the heat pipe is an apparatus that effectively transfers the heat without using power, even when there is only a little temperature difference between the heat source and the condenser, due to the use of latent heat caused by the vaporization and condensation of the fluid carrying heat. Furthermore, the conventional heat pipe has a wick structure, such as a screen mesh woven from fibers or a fiber bundle, arranged on an inner wall thereof, and the heat pipe uses capillary action in the wick structure to circulate the working fluid carrying heat.

In such a heat pipe, the wick structure of the heat pipe will undergo a sintering process to adhere the wick structure to an inner wall of a pipe container of the heat pipe. The wick structure is made of a kind of fiber material with same melting point in each fiber. It thus is easily melted in the sintering process, and may suffer deformation before being adhered to the inner wall of the pipe container of the heat pipe. However, these conventional wick structures all have the above problem of failing to provide a sufficient support force to ensure that the wick structure can completely adhere on the inner wall of the pipe container of the heat pipe, and so create instable capillary action and a poor heat-dissipating ability of the heat pipe.

In addition, in the past, support rods were provided to support the wick structure for solving above-mentioned sintering question. But due to the longer manufacturing time, the higher cost and the geometric structure of the pipe container parallel to the wick structure, even though the support rods will be used to insert into the inner of the pipe container as a support of the wick structure, the support rods also may be unable to insert into the inner of the pipe container because the fitting tolerance therebetween is difficult to control or the support rods may have no support effect because of the loosen thereof. Further, particularly in taking out the support rods, it is easier to make the wick structure be deformed or destroyed so as to influence the heat-dissipating effect of the heat pipe.

SUMMARY OF THE INVENTION

It is therefore a principal object of the invention to provide a heat pipe having at least two kinds of fibers with different melting points to constitute a fiber wick structure for ensuring that the fiber wick structure completely adheres to an inner wall of the heat pipe. Further, the higher melting point of fiber will provide a support force for the fiber wick structure to adhere to the inner wall of the pipe container, and the lower melting point of fiber will first reach the sintering temperature to make the wick structure be adhered on the inner wall of the pipe container.

To achieve the above object, the present invention provides a heat pipe including a pipe container and a fiber wick structure. The fiber wick structure is arranged on the inner wall of the pipe container, and the fiber wick structure has first and second fibers with different melting points. The melting point of the first fiber is higher than a sintering temperature of the pipe container and the melting point of the second fiber is lower than the sintering temperature of the pipe container. When the fiber wick structure undergoes a sintering process, the first fiber provides a support force for the fiber wick structure to adhere to the inner wall of the pipe container, and the second fiber provides a plurality of sticking sections melted in the sintering temperature to adhere with the first fiber on the inner wall of the pipe container.

To provide a further understanding of the invention, the following detailed description illustrates embodiments and examples of the invention, this detailed description being provided only for illustration of the invention.

BRIEF DESCRIPTION OF THE DRAWINGS

The drawings included herein provide a further understanding of the invention. A brief introduction of the drawings is as follows.

DETAILED DESCRIPTION OF THE EMBODIMENTS

Figure 1:
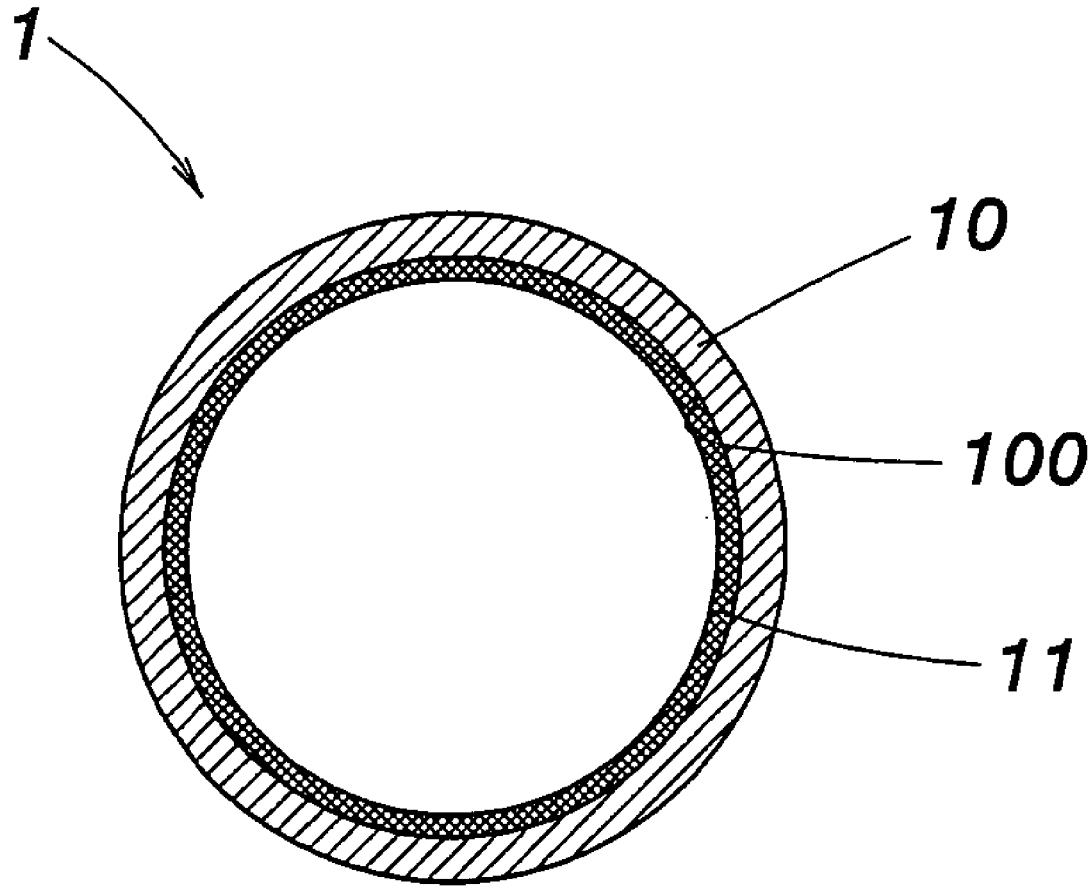
FIG. 1 is a cross-sectional view of a heat pipe in a radial direction of the present invention.

Wherever possible in the following description, like reference numerals will refer to like elements and parts unless otherwise illustrated.

Figure 2:
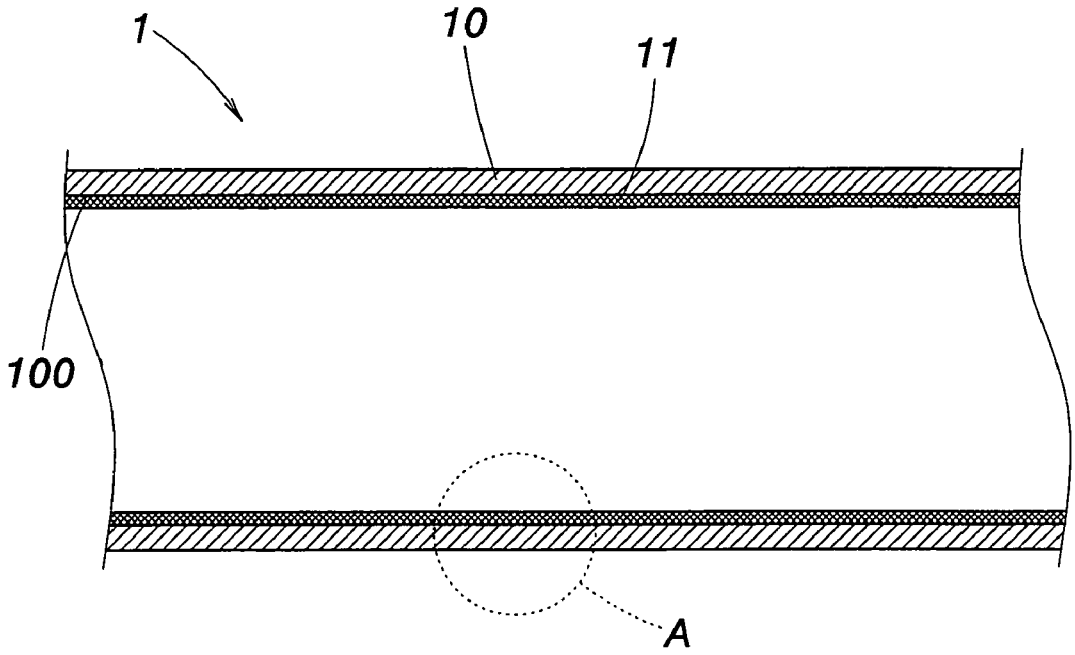
FIG. 2 is a cross-sectional view of the heat pipe in a longitudinal direction of the present invention.

FIGS. 1 and 2 are cross-sectional views of a heat pipe in a radial direction and in a longitudinal direction in accordance with an embodiment of the present invention.

Referring now to FIGS. 1 and 2, a heat pipe 1 in accordance with one embodiment of the present invention includes a pipe container 10 and a fiber wick structure 11. The pipe container 10 has a hollow inner portion for providing the fiber wick structure 11 therein and an inner wall 100 formed in the inner portion.

Figure 2A:
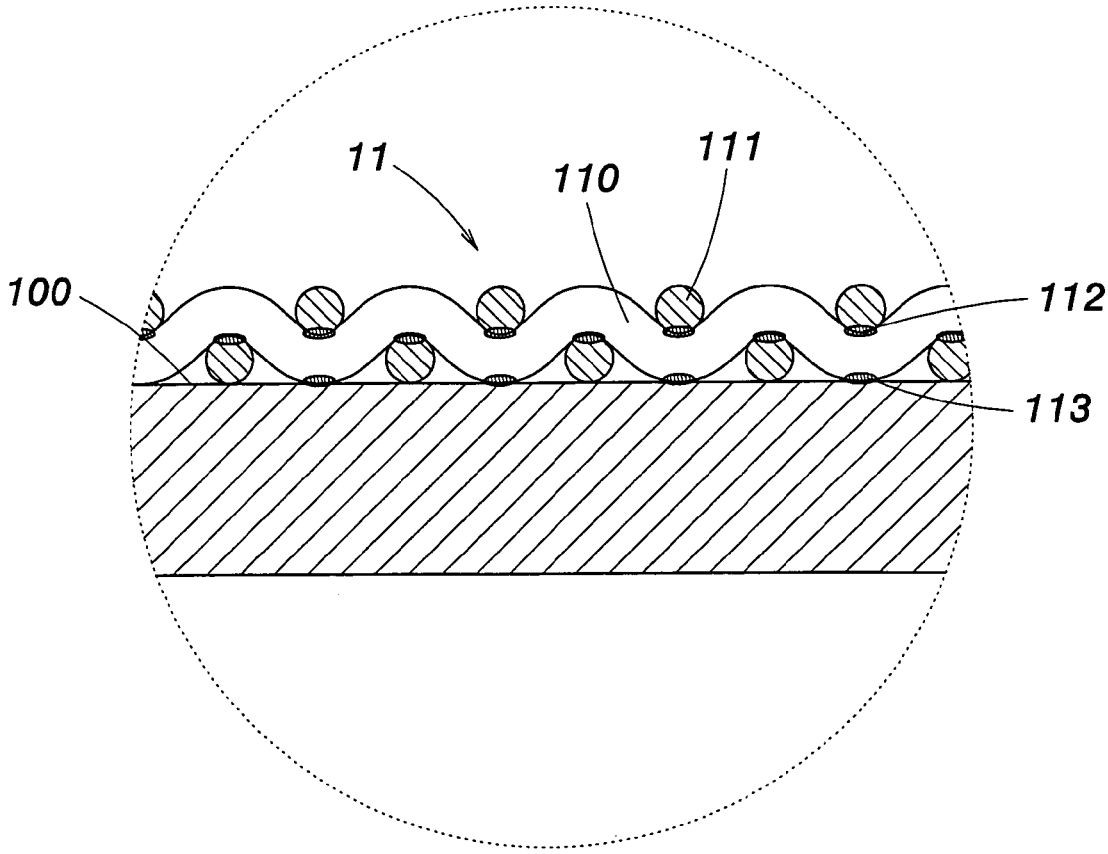
FIG. 2A is an enlarging view showing "A" part of FIG. 2.

The fiber wick structure 11 can be made of a screen mesh or a spiral fiber bundle, or the fiber wick structure 11 has fibers alternately woven with each other in order to arranged on the inner wall 100 of the pipe container 10. FIG. 2A illustrates the fiber wick structure 11 having different melting points of first and second fibers 111, 110. In the embodiment of the present invention, the first fiber 111 and the second fiber 110 are alternately woven with each other to constitute the fiber wick structure 11. The second fiber 110 defines a melting point lower than that of the first fiber 111 and the pipe container 10 (also the melting point of the first fiber 111 is lower than that of the pipe container 10). In particular, the melting point of the first fiber 111 will be higher than a sintering temperature of the pipe container 10 and the melting point of the second fiber 110 will be lower than the sintering temperature of the pipe container 10. Further, the second fiber 110 is arranged in a warp direction or in a weft direction of the fiber wick structure 11.

According to this structure of the heat pipe 1, when the fiber wick structure 11 is manufactured in a sintering process, a surface of the lower melting point of second fiber 110 will be melted in the sintering temperature of the pipe container 10, and the higher melting point of first fiber 111 will not be melted in the sintering temperature, thereby providing a support force for preventing the fiber wick structure 11 to crash due to softening, so as to be coupled to the inner wall of the pipe container 10 in a complete and better sticking condition. In the meantime, the lower melting point of second fiber 110 provides a plurality of sticking sections 112 melted in the sintering temperature to stick to the higher melting point of first fiber 111, and the lower melting point of second fiber 110 provides other sticking sections 113 melted in the sintering temperature to stick on the inner wall 100 of the pipe container 10.

Furthermore, due to the design of the present invention, conventional support rods need not be used to support the wick structure in the sintering process. In other words, the fiber wick structure 11 of the present invention utilizes itself to form the higher melting point of first fiber 111 for providing a support force thereby to obtain a support structure due to the fiber wick structure 11 and the inner wall 100 of the pipe container 10 sticking to each other. In addition, the fiber wick structure 11 of the present invention utilizes itself to form the lower melting point of second fiber 110 for providing an adhesion force, thereby obtaining a complete structure due to the fiber wick structure 11 and the inner wall 100 of the pipe container 10 being stuck to each other. Further, it will decrease defect in manufacturing the heat pipe 1 and obtain an improved heat-dissipating effect of the heat pipe 1.

There has thus been described a new, novel and heretofore unobvious heat pipe which eliminates the aforesaid problem in the prior art. Furthermore, those skilled in the art will readily appreciate that the above description is only illustrative of specific embodiments and examples of the invention. The invention should therefore cover various modifications and variations made to the herein-described structure and operations of the invention, provided they fall within the scope of the invention as defined in the following appended claims.

What is claimed is:

1. A heat pipe, comprising:

a pipe container, and a fiber wick structure arranged on an inner wall of the pipe container, the fiber wick structure including a first and a second fibers with different melting points;

wherein the melting point of the first fiber is higher than the sintering temperature of the pipe container and the melting point of the second fiber is lower than the sintering temperature of the pipe container;

whereby the sintered pipe container having that the first fiber provides a support force for the fiber wick structure while the melted surface of the second fiber adheres the fiber wick structure on the inner wall of the pipe container.

2. The heat pipe of claim 1, wherein the fiber wick structure is made of a screen mesh.

3. The heat pipe of claim 1, wherein the fiber wick structure is made of a spiral fiber bundle.

4. The heat pipe of claim 1, wherein the first fiber and the second fiber of the fiber wick structure are alternately woven with each other.

5. The heat pipe of claim 2, wherein the second fiber is arranged in a warp direction of the fiber wick structure of the screen mesh.

6. The heat pipe of claim 2, wherein the second fiber is arranged in a weft direction of the fiber wick structure of the screen mesh.

* * * * *